US005775706A

United States Patent [19]

Caeran

[11] Patent Number: 5,775,706

[45] Date of Patent: Jul. 7, 1998

[54] SKATE WITH IN-LINE WHEELS

[75] Inventor: Francesco Caeran, Montebelluna, Italy

[73] Assignee: Nordica S.p.A., Trevignano, Italy

[21] Appl. No.: 498,818

[22] Filed: Jul. 6, 1995

[30] Foreign Application Priority Data

Jul. 13, 1994 [IT] Italy ..... MI94A1459

[51] Int. Cl.[6] ..... A63C 17/06

[52] U.S. Cl. ..... 280/11.22; 36/115; 280/11.27

[58] Field of Search ..... 280/11.22, 11.23, 280/11.27, 11.28; 36/115, 114

[56] References Cited

U.S. PATENT DOCUMENTS

| | | | |
|---|---|---|---|
| 578,081 | 3/1897 | Gibbs et al. | 280/11.23 X |
| 593,278 | 11/1897 | Moulton | 280/11.23 |
| 2,168,820 | 8/1939 | Edstrom | 280/11.23 |
| 3,387,852 | 6/1968 | De Sarro | 280/11.22 |
| 5,330,208 | 7/1994 | Charron et al. | 280/11.22 |
| 5,380,020 | 1/1995 | Arney et al. | 280/11.22 |

FOREIGN PATENT DOCUMENTS

| | | | |
|---|---|---|---|
| 48723 | 2/1910 | Switzerland | 280/11.23 |
| 96483 | 10/1922 | Switzerland | 280/11.2 |
| 18312 | of 1891 | United Kingdom | 280/11.23 |

*Primary Examiner*—Brian L. Johnson
*Assistant Examiner*—Michael Mar
*Attorney, Agent, or Firm*—Guido Modiano; Albert Josif

[57] ABSTRACT

A skate with in-line wheels, including a shoe that is associated with a frame supporting a plurality of aligned wheels connected to the frame by means of pivot members. A pair of brackets are rigidly coupled to respective lateral sides of the shoe and are associated with front and rear pivot members.

2 Claims, 2 Drawing Sheets

SKATE WITH IN-LINE WHEELS

BACKGROUND OF THE INVENTION

The present invention relates to a skate with in-line wheels.

It is known that skates with in-line wheels are constituted by a frame that supports a plurality of aligned wheels connected to the frame by means of a respective rotation pivot.

The frame is shaped so as to form seats, generally in the upper part and above the region affected by the wheels, as shown for example in U.S. Pat. No. 5,046,746. The seats have holes for receiving the pins protruding from the lower part of the shoe in order to connect the shoe to the frame.

This solution, in addition to being extremely complicated from a structural point of view, since it requires the execution of a specially shaped frame, is also disadvantageous from a mechanical point of view, since the stresses between the shoe and the frame are transmitted exclusively at two pins having a vertical axis and arranged in the median portion of the shoe and accordingly can cause deformations in the shoe.

SUMMARY OF THE INVENTION

The aim of the present invention is to solve the above described problem by providing a skate with in-line wheels that improves the connection between the shoe and the frame, so as to obtain optimum stress distribution in addition to constructive simplification for the frame.

Within the scope of this aim, a particular object of the invention is to provide a skate which, while being equally strong, considerably lightens the frame, since the forces applied by the shoe are not discharged directly onto the frame.

Another object of the present invention is to provide a skate wherein the simplified structure of the frame considerably reduce costs.

Another object of the present invention is to provide a skate that, by virtue of a new type of coupling to the frame, has a particular and aesthetically pleasant aspect.

This aim, these objects, and others which will become apparent hereinafter are achieved by a skate with in-line wheels, comprising a shoe associated with a frame supporting a plurality of aligned wheels connected to the frame by means of a respective rotation pivot, characterized in that it comprises means for connecting the shoe and the frame that are constituted by tabs rigidly coupled to the shoe, each tab being associated with one of the pivots.

BRIEF DESCRIPTION OF THE DRAWINGS

Further characteristics and advantages will become apparent from the following description of two preferred but not exclusive embodiments of a skate with in-line wheels, illustrated only by way of non-limitative example in the accompanying drawings, wherein.

DESCRIPTION OF THE PREFERRED EMBODIMENTS

Figure 1:
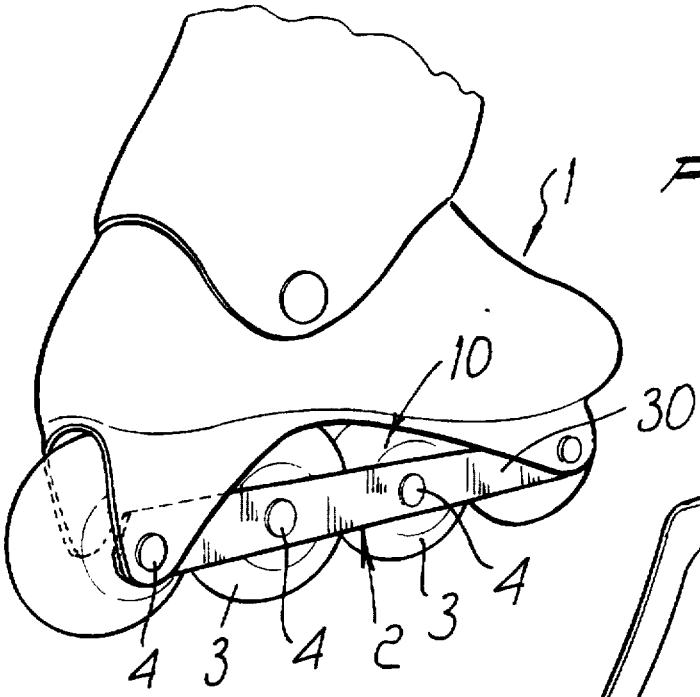
FIG. 1 is a perspective view of a first embodiment of the skate according to the invention.

With reference to the above figures, the skate with in-line wheels, according to the invention, comprises a shoe that is generally designated by the reference numeral 1 and is associated with a frame 2 supporting a plurality of aligned wheels 3 connected to said frame by means of respective pivots designated by the reference numeral 4.

The particularity of the invention resides in that there are means for connecting the shoe and the frame that are constituted by pairs of tabs rigidly coupled to the shoe, each pair being associated with one of the pivots 4.

Figure 2:
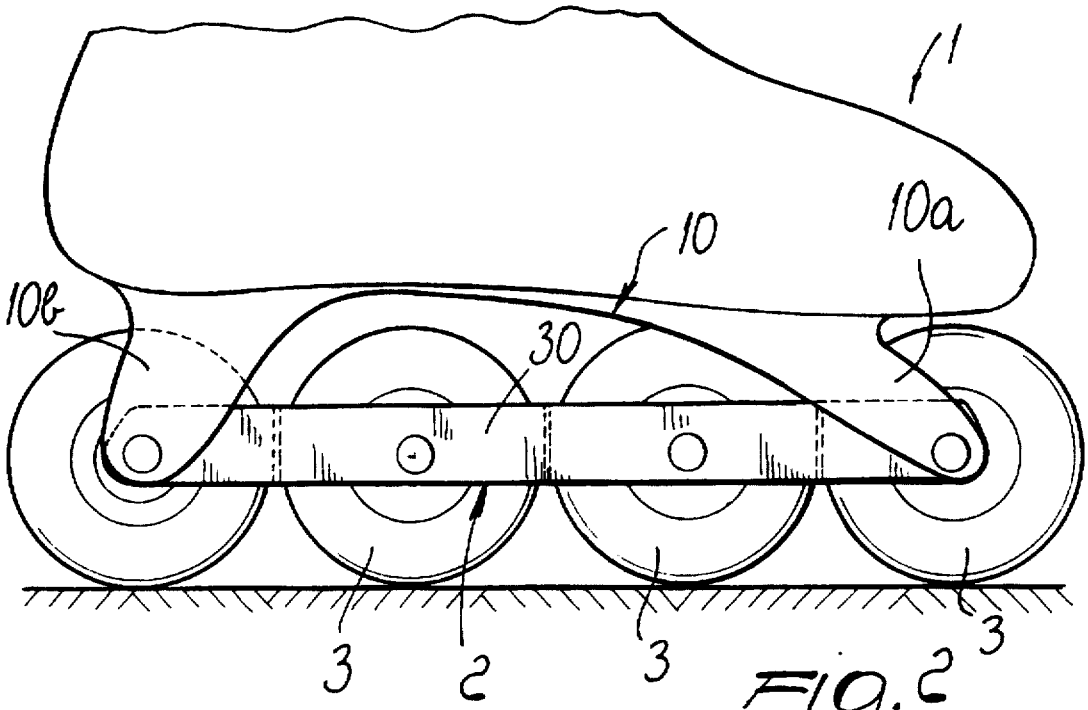
FIG. 2 is a lateral elevation view of the skate of FIG. 1.

As shown in FIGS. 1 and 2, the tabs, generally designated by the reference numeral 10, comprise front tabs **10*a* formed monolithically with the shoe, extending downwardly, and blended with rear tabs 10*b*** which are also formed monolithically with the shoe.

The tabs **10*a* and 10*b* are coupled, at their free ends, to the supporting pivots of the wheels 3** arranged at the ends of the frame.

The tabs are arranged laterally and externally with respect to the frame and thus provide direct connection of the shoe to the frame by using an element that is normally provided, such as the wheel rotation pivot.

Figure 3:
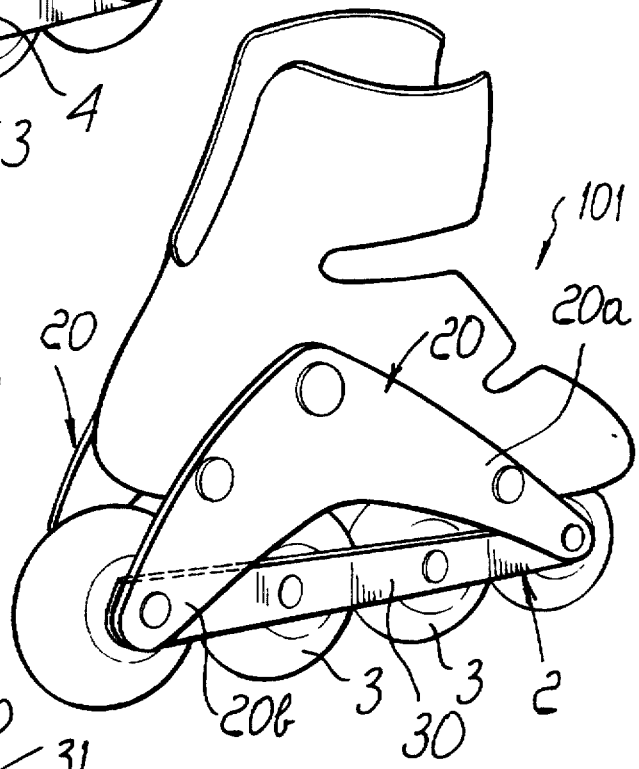
FIG. 3 is a perspective view of a second embodiment of the skate according to the invention.
Figure 4:
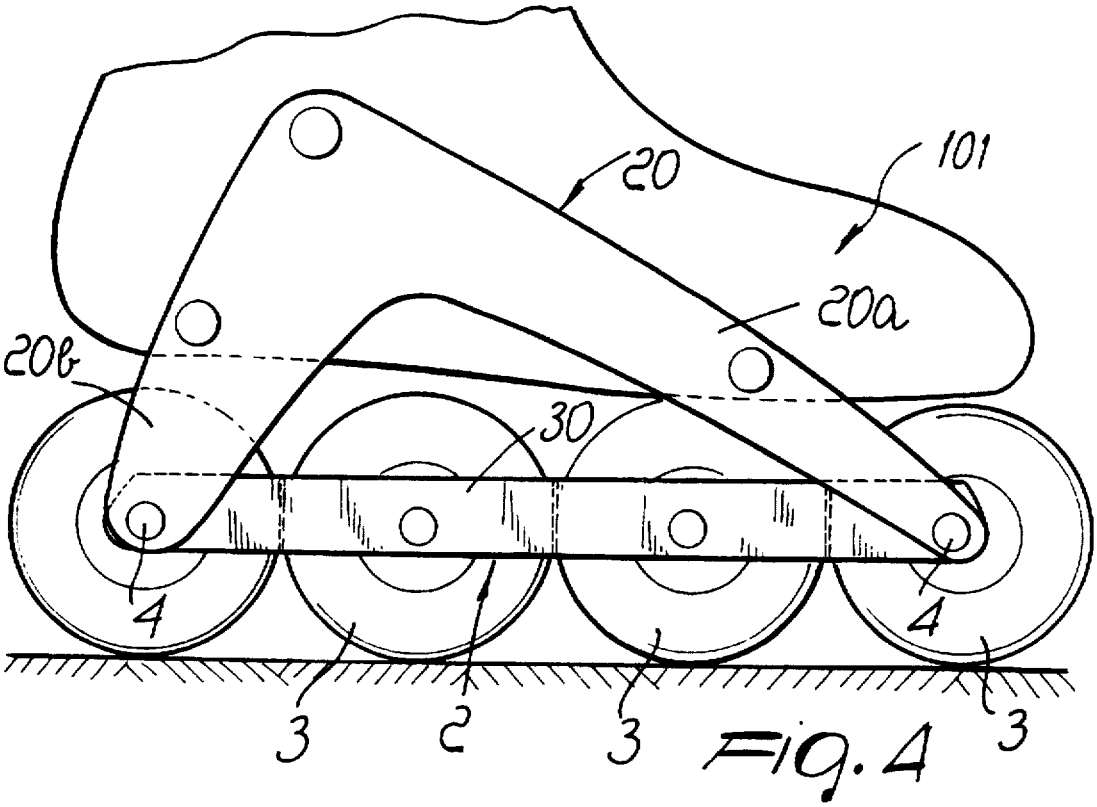
FIG. 4 is a lateral elevation view of the skate of FIG. 3.

The tabs, as shown in FIGS. 3 and 4, can also be constituted by brackets 20 fixed to the sides of the shoe 101 and ending with a front arm **20*a* and with a rear arm 20*b* that connect to the pivots of the wheels 3** arranged at the front and at the rear respectively.

In this embodiment, too, the shoe in practice is connected directly on the pivot of the wheel, that is to say, on the element normally provided in the manufacture of the skate, so that it is not necessary to give the frame particular shapes or profiles in order to connect the shoe.

Figure 5:
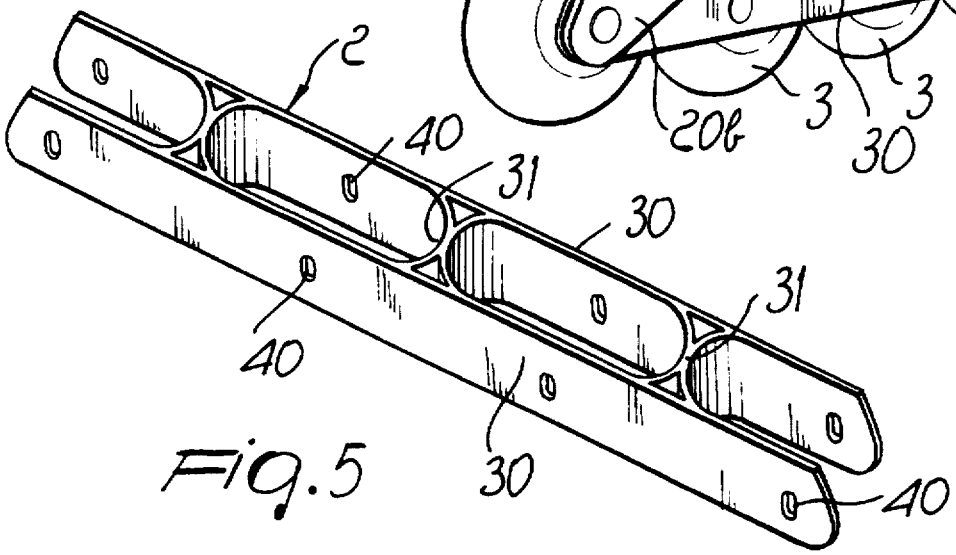
FIG. 5 is a perspective view of a frame for the skate according to the invention.

The frame, which is in practice not subjected to the stresses arising from its connection to the shoe, can be advantageously made of an aluminum extruded element which, as more clearly shown in FIG. 5, is constituted by two side walls 30 joined by cross-members 31, formed monolithically with said side walls.

Advantageously, the frame can be obtained by extruding a body along a direction substantially at right angles to the longitudinal extension of said frame.

In practice, it is possible to extrude a part that monolithically includes the side walls 30 and the cross-members 31 and then, with extremely quick machining operations, the frame portions are easily separated, in practice by cutting the side walls to the desired height and performing simple final finishing operations, such as chamfering at the free ends of the side walls and drilling of the holes 40 for the connection of the wheel supporting pivots.

From the above description it is thus evident that the invention achieves the intended aim and objects, and in particular the fact is stressed that a skate is provided which, having a new form of connection between the skate and the frame, considerably simplifies the mechanical coupling, since it uses a component normally present, such as the wheel rotation pivot, and it furthermore significantly lightens the frame, which no longer has to directly withstand the forces for connection to the shoe.

The skate according to the invention is susceptible of numerous modifications and variations, all of which are within the scope of the inventive concept.

All the details may be replaced with other technically equivalent elements.

In practice, the materials employed, as well as the contingent shapes and dimensions, may be any according to the requirements.

What is claimed is:

1. A skate with in-line wheels, comprising:

a shoe portion;

a wheel supporting frame comprising a pair of side walls which are mutually interconnected by at least one cross member;

a plurality of wheels;

pivot members which rotatably connect said wheels between said side walls of said wheel supporting frame; and a pair of brackets each of which is connected to a respective lateral side of said shoe portion and each of which comprises a front arm connected to a front pivot member and a rear arm connected to a rear pivot member.

2. The skate of claim 1, line wheels, comprising:

wherein said wheel supporting frame is a separate element from said pair of brackets;

and wherein said wheel supporting frame is exclusively connected to said shoe portion by means of the connection of said pair of brackets to said shoe portion and to said pivot members.

* * * * *